United States Patent [19]

Oka

[11] 4,434,221

[45] Feb. 28, 1984

[54] TONER CONCENTRATION DETECTION BY MEASURING CURRENT CREATED BY TRANSFER OF CARRIER COMPONENT TO NON-IMAGE AREAS OF IMAGE SUPPORT SURFACE

[75] Inventor: Tateki Oka, Toyokawa, Japan

[73] Assignee: Minolta Camera Kabushiki Kaisha, Osaka, Japan

[21] Appl. No.: 395,305

[22] Filed: Jul. 6, 1982

[30] Foreign Application Priority Data

Jul. 3, 1981 [JP] Japan ..... 56-104892

[51] Int. Cl.[3] ..... G03G 13/09

[52] U.S. Cl. ..... 430/122; 118/689; 430/30

[58] Field of Search ..... 430/122, 30; 427/7; 118/689

[56] References Cited

U.S. PATENT DOCUMENTS 3,527,651 9/1970 Shelffo et al. ..... 117/17.5
3,719,165 3/1973 Trachienberg et al. ..... 118/7
3,779,203 12/1973 Altmann ..... 118/689
4,226,525 10/1980 Sakamoto et al. ..... 118/689
4,342,822 8/1982 Hosono et al. ..... 430/122

*Primary Examiner*—John E. Kittle
*Assistant Examiner*—John L. Goodrow
*Attorney, Agent, or Firm*—Wenderoth, Lind & Ponack

[57] ABSTRACT

An improved toner concentration detection and control method to be applied to an electrophotographic copying apparatus or the like which is so arranged that, part of an electrostatic latent image support member outside its image region is utilized as a carrier adhering region, while the carrier adhering region is subjected to developing by a magnetic brush of a magnetic developing material, and during the above developing, magnetic carrier is caused to adhere to the carrier adhering region, with simultaneous measurement of current flowing between a developing electrode and the electrostatic latent image support member so as to control the replenishing amount of toner with respect to the magnetic developing material.

6 Claims, 7 Drawing Figures

TONER CONCENTRATION DETECTION BY MEASURING CURRENT CREATED BY TRANSFER OF CARRIER COMPONENT TO NON-IMAGE AREAS OF IMAGE SUPPORT SURFACE

BACKGROUND OF THE INVENTION

The present invention generally relates to an electrographic process and more particularly, to a method of detecting and controlling toner concentration for an electrographic copying apparatus which is provided with a developing device arranged to develop an electrostatic latent image through employment of a developing material composed of a mixture of toner and carrier.

Although various kinds of toner concentration control methods of the above described type have been proposed, they have such disadvantages that complicated arrangements are required therefor or control of toner concentration is not accurately effected at all times. Among the methods as referred to above, as a practice suitable for a toner image transfer type electrophotographic copying apparatus, there has been known one method which includes such steps as, where a reference image is provided at a leading edge or trailing edge of an original document platform, the reference image is projected for exposure onto a corresponding leading edge or trailing edge of an image area of a photosensitive member (i.e. electrostatic latent image support member) during each exposing process of the original document to be copied, so as to form a reference latent image for the toner concentration control thereat, and said reference latent image is developed during a developing process for forming a toner concentration control image, and further, by measuring the amount of toner adhering to said reference latent image based on light reflected from said control image by a photoelectric conversion element between a transfer process station and a cleaning process station, the amount of toner needed for the replenishment of the developing material accommodated in the developing device is controlled comparatively accurately according to said amount of adhering toner, by a known toner replenishing control circuit including a comparison circuit or the like.

The method as described above, however, still has problems in that, since the reference image is provided at the leading edge or trailing edge of the original document platform for the formation of the reference latent image, the optical system or original document platform must be subjected to additional scanning by an amount necessary for exposing the reference image, thus resulting in a larger size of the copying apparatus itself, and in that the space required for installing the photoelectric conversion element in the vicinity of the photosensitive member so as to receive light reflected from the control image, cannot be easily provided in many cases particularly in a copying apparatus employing a photoreceptor drum of a small diameter.

On the other hand, there has been developed by the present inventor, another method in which, instead of effecting an optical measurement as described above, current flowing between a developing electrode and an electrostatic latent image support member is measured during developing of the reference latent image by the magnetic brush of magnetic developing material.

The method will be described in more detail hereinbelow with reference to an arrangement of FIG. 1 which includes a rotatable photosensitive or photoreceptor drum P having a photosensitive surface Pa provided therearound, a developing sleeve S made of electrically conductive non-magnetic material and disposed adjacent to the photosensitive surface Pa of the photoreceptor drum P so as to function as a developing electrode, a magnetic roll M accommodated in said developing sleeve S, and a current measuring circuit C inserted between the developing sleeve S and the ground.

In the above arrangement of FIG. 1, during development of a reference latent image formed on the photosensitive surface Pa of the photoreceptor drum P by a developing material TC (which in this case is composed of a mixture of a high resistance magnetic carrier and an electrically insulative toner), the insulative toner adheres onto the reference latent image. During this time, current flowing between the developing sleeve S and the photoreceptor drum P is measured by the current measuring circuit C which measures the above current as a current flowing through the developing sleeve S. The current value thus measured and the toner concentration of the developing material TC are in a predetermined correlation to each other, according to which correlation, the amount of toner needed for replenishment is controlled, based on the current value as measured in the above described manner.

In the above practice, however, variation of the current value due to variation of the toner concentration is not as large as the variation in the amount of toner adhering to the reference latent image in the method earlier described, and thus, this practice is inferior to said earlier described method in the accuracy of detecting the toner concentration, with a consequent difficulty in effecting a proper control of the amount of replenishing toner. According to an analysis made by the present inventor, the above disadvantages are considered to be attributable to variation of the amount of charge on the insulative toner in a direction to cause deterioration of the detecting accuracy as shown in FIG. 2.

It should be noted here that in FIG. 2, the amount of charge on the toner has been obtained by, when the toner is charged and adapted to be electrostatically attracted onto the surface of a uniformly charged insulative sheet, measuring the amount of reduction of apparent surface potential of the insulative sheet resulting therefrom and the amount of the attracted toner, respectively. The attraction of the toner described above was effected by developing the surface of the insulative sheet.

SUMMARY OF THE INVENTION

Accordingly, an essential object of the present invention is to provide a method of detecting toner concentration and also a method of controlling the toner concentration based on said detecting method, which method of detecting requires no reference image (reference latent image), and no optical measuring means, etc. to be disposed in the vicinity of an electrostatic latent image support member, and yet is capable of detecting toner concentration with high accuracy.

Another important object of the present invention is to provide the methods as described above which can be readily applied to various kinds of copying apparatuses and the like.

In accomplishing these and other objects, according to the present invention, an improved toner concentration control method utilizes part of an electrostatic latent image support member outside the image region as a carrier adhering region, and the carrier adhering region is subjected to developing by a magnetic brush of a magnetic developing material, and during the above developing, magnetic carrier is caused to adhere to said carrier adhering region, while simultaneous measurement of current flowing between a developing electrode and the electrostatic latent image support member is carried out so as to control the amount of toner needed to replenish said magnetic developing material.

More specifically, according to one preferred embodiment of the present invention, there is provided a method of controlling toner concentration to be applied to an electrographic copying apparatus of a type in which an image region on a surface of an electrostatic latent image support member for supporting thereon an electrostatic latent image having a polarity opposite to the charge polarity of an electrically insulative toner, is developed by a magnetic brush of a magnetic developing material composed of a mixture of a high resistance magnetic carrier and an electrically insulative toner which are respectively triboelectrically charged to different polarities, and a developing bias source is connected to a developing electrode so as to impress a developing bias having the same polarity as that of the electrostatic latent image on the developing electrode at least during the developing of the image region. The toner concentration control method comprises the steps of utilizing part of the electrostatic latent image support member outside the image region thereof as a carrier adhering region, developing the carrier adhering region by the magnetic brush, causing the carrier to adhere to the carrier adhering region during the developing, measuring current flowing between the developing electrode and the electrostatic latent image support member during the adhesion of the carrier to the carrier adhering region, and controlling the amount of the toner used to replenish the magnetic developing material according to value of the current thus measured.

By the steps as described above, an improved toner concentration control method has been advantageously provided, with substantial elimination of disadvantages inherent in the conventional methods of this kind.

BRIEF DESCRIPTION OF THE DRAWINGS

These and other objects and features of the present invention will become apparent from the following description of a preferred embodiment thereof and with reference to the accompanying drawings, in which.

Before the description of the present invention proceeds, it is to be noted that like parts are designated by like reference numerals throughout the accompanying drawings.

DETAILED DESCRIPTION OF THE INVENTION

In the first place, it is to be noted that the present inventor has already proposed that, in a magnetic brush developing method employing a two-component developing material including toner and magnetic carrier, when the magnetic carrier having particle diameters of 5 to 40 $\mu$m similar to those of the toner, with a volume resistance higher than $10^{10}$ $\Omega$·cm and prepared by dispersing fine magnetic particles into an insulative resin is employed, bristles of the magnetic brush are advantageously softened, while the specific surface area is greatly enlarged as compared with the same amount of large diameter carrier, and thus, developed images having a high resolution are obtained without fogging, with simultaneous broadening of the variation of the allowable range for the toner concentration and improved durability of the developing material. In the magnetic brush developing method of the above described type, developing bias of the same polarity as that of the electrostatic latent image is impressed on a magnetic brush support member, i.e. the developing electrode, so that the toner will not adhere to the non-image portion of the image region, i.e. to the background portion of the electrostatic latent image. However, due to the fact that the magnetic carrier is charged to a polarity opposite that of the charge of the toner due to frictional contact therewith and retains said charge, said magnetic carrier may adhere to a certain extent to the surface of the electrostatic latent image support member outside the image region thereof by adjustment of the voltage value of the developing bias, amount of charge on the magnetic carrier, etc. In the above case, as confirmed by the present inventor, current corresponding to the amount of the carrier which adheres flows between the developing electrode and the electrostatic latent image support member, and since the amount of adhering carrier depends on the toner concentration, the value of the above current similarly depends on the toner concentration, and tends to vary comparatively largely according to the variation of the toner concentration.

According to the present invention, the toner concentration is detected by measuring the current as described above, and in addition, the amount of toner provided to replenish the developing material accommodated in the developing device is controlled according to the current value thus measured.

Figure 3:
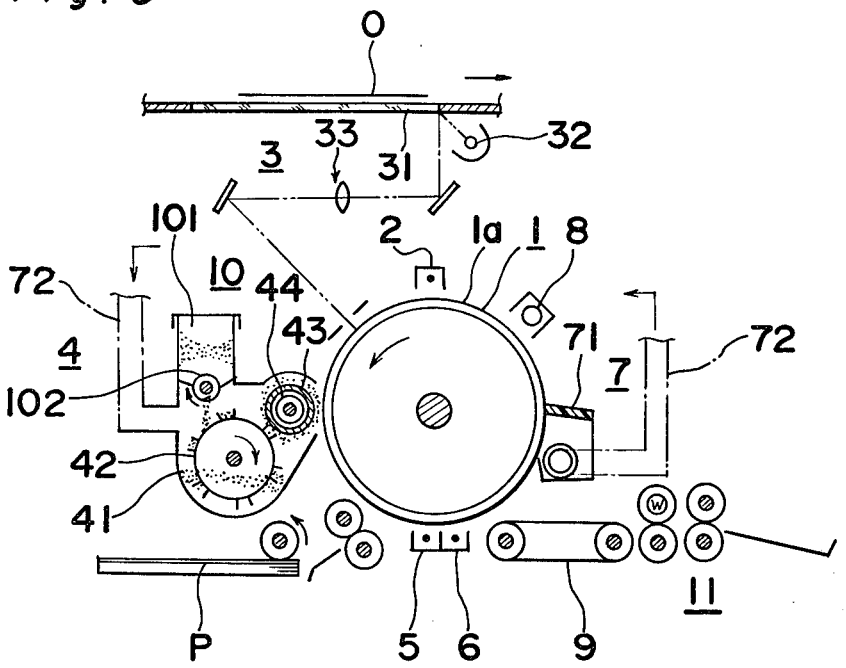
FIG. 3 is a schematic diagram showing the general construction of a toner image transfer type electrophotographic copying apparatus to which the method of controlling toner concentration according to the present invention may be applied.

Referring now to the drawings, there is shown in FIG. 3, a toner image transfer type electrophotographic copying apparatus to which the toner concentration detecting and control method according to the present invention may be applied.

In the copying apparatus of FIG. 3, at approximately the central portion thereof, a photosensitive or photoreceptor drum 1 having a photosensitive or photoconductive surface 1*a* provided therearound is rotatably disposed for rotation in the counterclockwise direction as indicated by the arrow, around which photoreceptor drum 1, there are sequentially disposed in a known manner, a corona charger 2 for uniformly charging the photosensitive surface 1*a*, an image exposure device 3 for projecting a light pattern of an original document O to be copied onto the photosensitive surface 1*a* so as to form an electrostatic latent image of the original document thereon, a developing device 4 for developing the latent image thus formed into a visible toner image by the developing material, a transfer corona charger 5 for electrostatically transferring the toner image onto a transfer material such as a copy paper sheet P, a copy paper separating corona charger 6, a cleaning device 7 and an eraser lamp 8, etc.

In the copying apparatus of FIG. 3 as described above, the image exposure device 3 is of a type in which a transparent platform 31 carrying thereon the original document O to be copied is adapted to reciprocate for scanning, and the light image of the original document O illuminated by an exposure lamp 32 provided below and adjacent to the platform 31 is successively projected onto the photosensitive surface 1*a* of the drum 1 uniformly charged by the corona charger 2, through an optical system 33 so as to form the electrostatic latent image corresponding to the original document O on the photosensitive surface 1*a* for developing said latent image by the subsequent developing device 4.

On the other hand, the copy paper sheet P fed by a copy paper feeding device of a cassette type (not specifically shown) provided at the lower left portion of FIG. 3 has the toner image formed on the photosensitive surface 1*a* of the drum 1 transferred thereto by the transfer charger 5 at the transfer position, and then is separated from the surface 1*a* of the drum 1 by the separating charger 6 so as to be further transported by a transport belt 9 out of the apparatus after the transferred image has been fixed thereto by a fixing device 11.

The cleaning device 7 disposed subsequent to the separating corona charger 6 is of a type which scrapes the developing material remaining on the photosensitive surface 1*a* after the transfer off that surface by keeping a blade 71 in a sliding contact with said photosensitive surface 1*a* of the drum 1, and the developing material thus scraped off is returned to the developing device 4 through a circulation pipe 72 for repeated use for further development. Meanwhile, the residual potential on the photosensitive surface 1*a* is dissipated by the eraser lamp 8.

Figure 4:
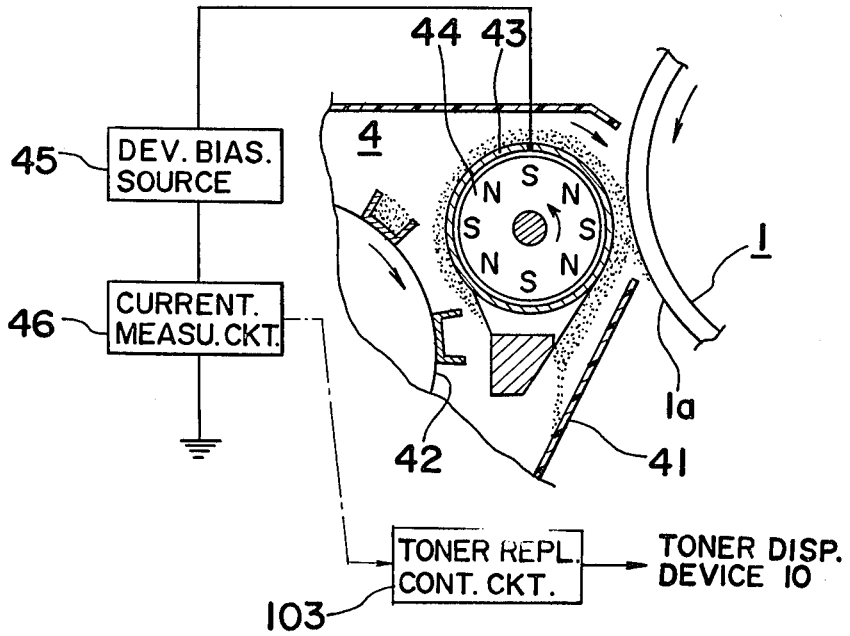
FIG. 4 is a fragmentary side sectional view of a developing device employed in the copying apparatus of FIG. 3, and FIGS. 5, 6 and 7 are graphs respectively showing relations of detected current values, amounts of adhering carrier and amounts of carrier charge with respect to the toner concentration.

As shown in FIG. 4, the developing device 4 is a so-called magnetic brush type which includes, for example, a rotary developing sleeve or outer cylinder 43 functioning as a developing electrode and a magnetic member or magnetic roll 44 rotatably enclosed in said developing sleeve 43 and a stirring and transporting bucket roll 42, etc., which are accommodated in a developing material tank 41. The developing sleeve 43 of electrically conductive non-magnetic material such as stainless steel or the like is arranged to be driven for rotation, for example, in the counterclockwise direction, and is provided in a position adjacent to the photosensitive surface 1*a* of the drum 1 within the developing material tank 41, while the magnet roll 43 having a plurality of magnetic poles arranged in alternately different polar orientation is rotatably provided within said developing sleeve 42 for rotation in the counterclockwise direction at a speed higher than that of the developing sleeve 43. On the developing material tank 41 of the developing device 4, there is disposed an automatic toner dispensing device 10 to be described later. A developing bias source 45 is connected to the developing sleeve 43 for impressing a developing bias having the same polarity as that of the electrostatic latent image on said developing sleeve 43, and a current measuring circuit 46 is connected between the developing bias source 45 and the ground, and the current measuring circuit 46 is further coupled to the automatic toner dispensing device 10 through a toner replenishing control circuit 103.

It should be noted here that the developing device 4 as described above is non-operative except when developing the image region and carrier adhering region to be described later, and during such non-operative period, the developing material 20 does not rub against the photosensitive surface 1*a* of the photoreceptor drum 1.

The automatic toner dispensing device 10 generally includes a hopper or toner tank 101 and a toner replenishing roller 102 rotatably provided in the lower opening of said toner tank 101, and the rotation of said roller 102 is subjected to on/off control by the toner replenishing control circuit 103. The roller 102 provided with a plurality of axially extending toner replenishing grooves or recesses (not specifically shown) which cause the toner particles accommodated in the toner tank 101 to fall into the developing material tank 41 for replenishment of toner therein.

In the embodiment according to the present invention to be described hereinbelow, there is employed a two-component magnetic developing material comprising an electrically insulative toner having an average particle diameter of 11 μm and a high resistance magnetic carrier of comparatively small diameter (average particle diameter of 20 to 25 μm and more specifically, 21 μm) having a volume resistivity higher than $10^{13}$ Ω·cm and more specifically, $10^{14}$ Ω·cm, and prepared by dispersing magnetic fine particles into an electrically insulative resin. Where the electrostatic latent image formed on the photosensitive surface 1*a* of the photoreceptor drum 1 has a negative charge, the toner and the carrier are respectively charged to a positive polarity for the toner and a negative polarity for the carrier by frictional contact therebetween. Meanwhile, a developing bias of the same polarity as that of the electrostatic latent image is kept impressed on the developing sleeve 43 by the developing bias source 45 so as to prevent the toner from adhering to the background portion of the electrostatic latent image.

By the above arrangement, the developing material formed into a magnetic brush configuration on the developing sleeve 43 rubs against the electrostatic latent image formed on the photosensitive surface 1*a* of the photoreceptor drum 1, while moving in the clockwise direction over the developing sleeve 43, and thus, the developing is effected by the adhesion of toner only onto the electrostatic latent image in the image region.

In the process as described above, when the amount of toner in the developing material gradually increases, i.e. as the toner concentration in the developing material becomes high, the carrier is increasingly triboelectrically charged, with the amount of charge thereof being increased. Consequently, due to the negative developing bias impressed on the developing sleeve 43, a potential difference (the developing sleeve 43 is caused to have a negative polarity with respect to the carrier adhering region of the photoreceptor drum) develops between the developing sleeve 43, and the region outside the image region of the photoreceptor drum 1, i.e. the recarrier adhering region (it is to be noted here that, in the present embodiment, said carrier adhering region has its surface potential adjusted in a manner as described later), the carrier having the negative charge comes to have a stronger tendency to adhere to said carrier adhering region than to the sleeve 43 by overcoming the retaining force of the magnetic roll 44 within the developing sleeve 43. In this state, current flowing between the developing sleeve 43 and the photoreceptor drum 1 is measured by the current measuring circuit 46 as a current flowing through the developing bias impressing electrical path. The amount of adhering carrier in the above case increases in proportion to the amount of charge possessed by the carrier, and the increase is in a relation which increases as the toner concentration in the developing material becomes high. Accordingly, the current value as measured by the current measuring circuit 46 also increases with the increase of the toner concentration in the developing material and thus varies according to the toner concentration. The measured current value as described above is applied to the toner replenishing control circuit 103 which subjects the rotation of the toner replenishing roller 102 to the on/off control, and thus, the amount of toner replenished is controlled.

For the carrier adhering region as described above, part of a portion on the photosensitive surface 1*a* of the photoreceptor drum 1 outside the image region, and located forwardly or rearwardly with respect to said image region is utilized. Where copying is continuously effected, the portion located between the respective image regions is employed. Incidentally, the carrier adhering region described above is required to have a surface potential lower than that of the developing bias, or to have a surface potential with a polarity opposite to that of the electrostatic latent image where a developing bias of the same polarity as that of the electrostatic latent image is impressed on the developing sleeve 43 even during the developing of the carrier adhering region. In the latter case, during the development of the carrier adhering region, a developing bias need not necessarily be applied to the developing sleeve 43, if the surface potential of the carrier adhering region is sufficiently high.

It should be noted here that the portion to be utilized as the carrier adhering region, i.e. the surface 1*a* of the photoreceptor drum 1 to which the carrier adheres should preferably have a minimum area sufficient for the detection of toner concentration.

In the above case, for providing the carrier adhering region with the surface potential lower than that of the developing bias, it can be the practice to turn OFF the corona charger 2 when the carrier adhering region passes immediately below said corona charger 2, and the surface potential of the carrier adhering region in the present embodiment is caused to be the same surface potential as in the former. On the other hand, for providing the carrier adhering region with a surface potential where the developing sleeve bias has a polarity opposite that of the image, a separate charger can be provided for charging the photosensitive surface 1*a* of the photoreceptor drum 1 to a polarity opposite to that of the electrostatic latent image, said charger being turned ON only when the carrier adhering region passes therethrough for charging the carrier adhering region to said polarity prior to the developing. It is to be noted here that the image region referred to above means the region which has been charged by the corona charger 2 and onto which the image of the original document has been projected.

Experiments carried out by the present inventor are described hereinafter for the purpose of illustrating the present invention, without any intention of limiting the scope thereof.

For the experiments to be described hereinbelow, the developing device described earlier with reference to FIGS. 3 and 4 was employed.

With the potential of electrostatic latent image set at the maximum −550 V, the gap between the photoreceptor drum 1 and the developing sleeve 43 at 0.7 mm, the magnetic force on the developing sleeve 43 of the magnetic roll 44 at 1000 G, the speed of rotation of the developing sleeve 43 at 30 r.p.m., the speed of rotation of the magnetic roll 44 at 1300 r.p.m., and the voltage for the developing bias at −300 V, a developing material composed of a mixture of an insulative toner having average particle diameters of 10 to 15 μm and a resistance value higher than $10^{14}$ Ω·cm, and a magnetic carrier having average particle diameters of 20 to 25 μm and resistance value higher than $10^{13}$ Ω·cm was employed.

For the carrier adhering region, part of the region located before and after the image region and having a surface potential of −15 V (which is equivalent to the surface potential of the photosensitive surface 1*a* of the photoreceptor drum 1 after the charge thereon has been dissipated by the eraser lamp 8) through the on/off control of the corona charger 2, was utilized. It is to be noted that the region as described above is formed before and after the image region by turning ON the corona charger 2 only with respect the image region.

Figure 1:
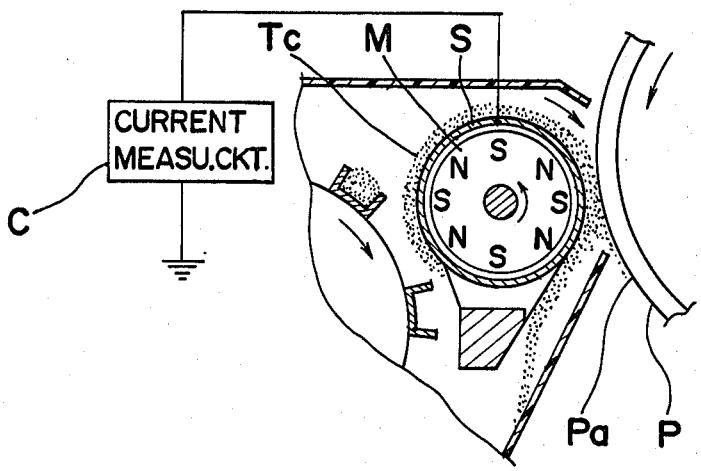
FIG. 1 is a fragmentary side sectional view of a developing device for explaining one example of a toner concentration control method (already referred to)
Figure 2:
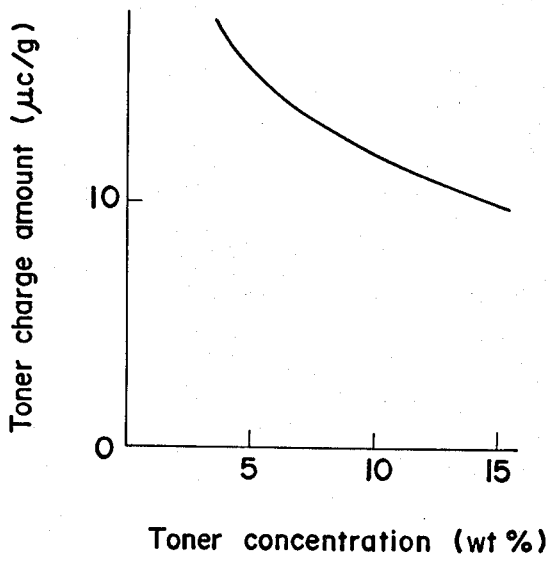
FIG. 2 is a graph showing the relation between the amount of toner charge and the toner concentration of a developing material (already referred to)
Figure 5:
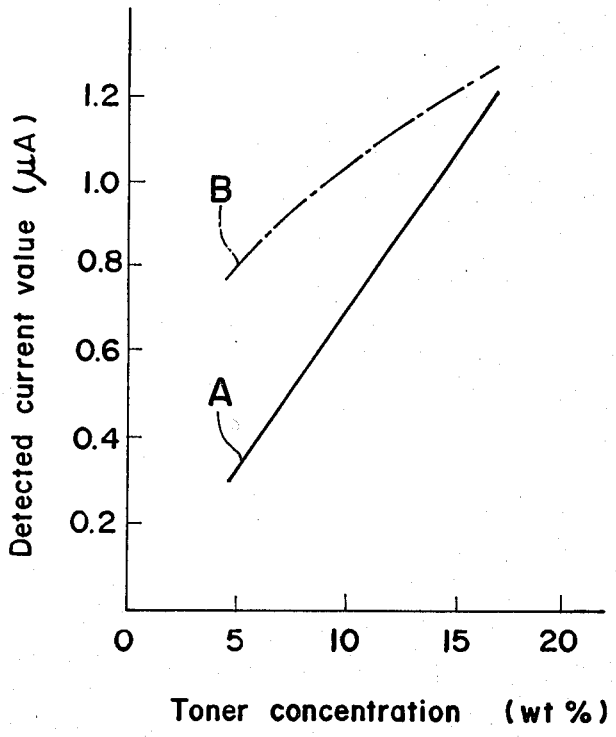
Figure 6:
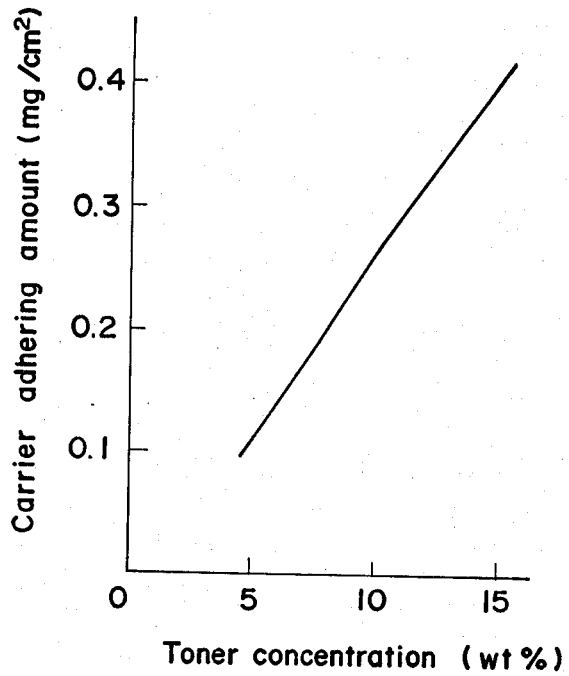
Figure 7:
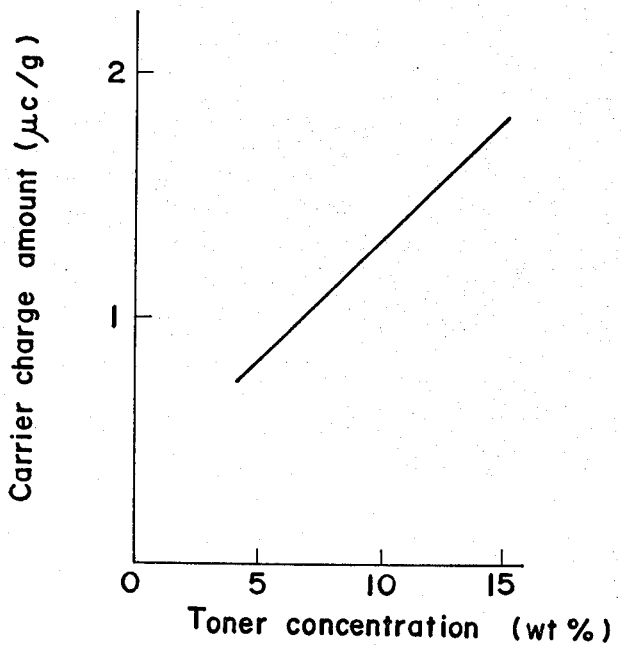

The relation between the current value measured by the current measuring circuit 46 arising from the adhesion of the carrier to the carrier adhering region as described earlier and the toner concentration is as represented by a solid line A in a graph of FIG. 5, while the relation between the amount of adhesion of the carrier and the toner concentration is as shown by a graph of FIG. 6. In this case, the relation between the amount of charge on the carrier and the toner concentration is assumed to be as represented by a graph of FIG. 7. As seen from the graph of FIG. 5, the measured current value increases at a constant large gradient as the toner concentration increases, and the amount of variation of said current value with respect to the toner concentration is larger than the amount of variation of the current value (which is represented for reference, by a one-dotted chain line B in FIG. 5) obtained by the method of FIG. 1, resulting in an improvement of accuracy of detection of the toner concentration. This is considered to be attributable to the fact that, as compared with the amount of charge on the toner, the amount of triboelectric charging of the magnetic carrier is increased with an increase of the toner concentration.

According to the present invention, the toner concentration is caused to be maintained at the set value by detecting, based on the correlation between the toner concentration and the current value due to the adhesion of carrier onto the carrier adhering region as described earlier, the toner concentration by the measurement of the current value at the time of carrier adhesion and comparing the current value with a current value for a preliminarily set toner concentration, and if the measured current value is low as compared with that for the preliminarily set toner concentration, and more specifically, when the detected current value is less than 0.7 μA at a set toner concentration of 10 ωt% (FIG. 5), the toner replenishing roller 102 is caused to rotate for the replenishment of toner.

In the experiments as described above, as a result of measurements for the toner concentration effected by taking out part of the developing material contained in the developing device 4 each time 500 sheets were copied during copying of 10,000 copy paper sheets by altering the kinds of original documents being copied, it was found that the toner concentrations thus measured were all within the allowable range between 9.5 and 10.5 ωt%.

It should be noted here that although the embodiment as described so far relates to the case where the magnetic particles having average particle diameters of 20 to 25 μm and volume resistivity higher than $10^{13}$ Ω·cm are employed as the magnetic carrier, the correlation between the toner concentration and the amount of the carrier adhering in the carrier adhering region holds even in the case where magnetic particles with average particle diameters of 5 to 40 μm and volume resistivity higher than $10^{10}$ Ω·cm are employed, and similar results can be obtained by detecting the current value flowing through the developing bias impressing electric path as an indication of the amount of the carrier adhering to the carrier adhering region.

It should also be noted here that in the foregoing embodiment, in order to cause the carrier in the developing material to adhere to the carrier adhering region during the developing of the carrier adhering region, the developing bias is applied to the developing sleeve also during said developing, while the surface potential of the carrier adhering region is adapted to be lower than the potential of the developing bias. However, the carrier may similarly be caused to adhere by other practices. In short, such adhesion of carrier takes place only if an electric field is established in a direction in which the carrier in the developing material forming the magnetic brush is electrostatically attracted onto the photosensitive surface of the photoreceptor drum and between said photosensitive surface to be utilized as the carrier adhering region and the developing sleeve during the development of the carrier adhering region. Therefore, by way of example, it is possible to cause the adhesion of the carrier to take place also by varying the potential of the developing bias during the developing of the carrier adhering region so that a developing bias voltage biased towards the polarity of the electrostatic latent image with respect to the surface potential of the carrier adhering region is impressed on the developing sleeve during the developing of the carrier adhering region. In such case, however, it is necessary to make the degree of biasing sufficiently large for causing the carrier adhesion to readily occur, and in the case where the method of causing the carrier adhesion as described in the foregoing embodiment is to be altered to the practice as described above, biasing of approximately 300 V is required.

As is clear from the foregoing description, according to the present invention, part of the electrostatic latent image support member outside the image region thereof is utilized as a carrier adhering region, and this carrier adhering region is developed by the magnetic brush of the magnetic developing material so as to cause the magnetic carrier to adhere to the carrier adhering region during the developing, and the current flowing between the developing electrode and the electrostatic latent image support member is measured for controlling the amount of toner needed for replenishment to maintain the ratio thereof with respect to the magnetic developing material according to the current value thus measured. Therefore, the reference image (reference latent image) as required in the method earlier described is not required in the present invention, removing the necessity for an extra scanning of the optical system or original document platform. Moreover, since the current measuring means may be installed in the developing bias impression electric circuit, etc., without the necessity for providing any optical measuring means or the like in the vicinity of the electrostatic latent image support member, there is no inconvenience in providing a space for installing the measuring means, even when the electrostatic latent image support member (i.e. the photoreceptor drum) to be used in a copying apparatus has a small diameter. Furthermore, owing to the fact that the above measured current value varies mostly due to the toner concentration, high detecting accuracy can be achieved with a resulting accurate detection of the toner concentration.

It is to be noted here that, in the foregoing description, although an explanation has been given based on the assumption that the current flows between the developing sleeve and the photoreceptor drum upon adhesion of the toner or carrier onto the surface of the photoreceptor drum, in the most accurate sense the current flows merely between the developing sleeve and the ground due to the above adhesion sense, and can only be apparently regarded as having flowed between the developing sleeve and the photoreceptor drum. More specifically, as a matter of fact, what is observed is nothing but a phenomenon in which it seems as if the apparent current as described above were actually produced by the movement of toner having a charge or carrier between the developing sleeve and the photoreceptor drum. In the foregoing description, however, since it is easier to explain on the supposition that the current flows therebetween, all the explanation has been given on such assumption for convenience.

Although the present invention has been fully described by way of example with reference to the accompanying drawings, it is to be noted here that various charges and modifications will be apparent to those skilled in the art. Therefore, unless otherwise such changes and modifications depart from the scope of the present invention, they should be construed as being included therein.

What is claimed is:

1. A method of controlling toner concentration of an electrically insulative toner forming part of a magnetic developing material in an electrophotographic copying apparatus of a type in which the image region on the surface of an electrostatic latent image support member for supporting thereon an electrostatic latent image having a polarity opposite to the charge polarity of the electrically insulative toner, is developed by a magnetic brush of the magnetic developing material, the developing material being composed of a mixture of a high resistance magnetic carrier having a volume resistivity of more than $10^{10}$ Ω·cm and the electrically insulative toner which are respectively triboelectrically charged to different polarities, and which copying apparatus has a developing bias source connected to a developing electrode so as to impress a developing bias having the same polarity as that of the electrostatic image on said developing electrode at least during the developing of the image region, said toner concentration control method comprising the steps of:

(a) utilizing part of the surface of said image support member outside the image region thereof as a carrier adhering region by, at the time said carrier adhering region passes said magnetic brush, forming an electric field between the surface of said image support member and said developing electrode in a direction for and sufficiently strong causing the carrier in the developing material forming the magnetic brush to be electrostatically attracted onto the carrier adhering region of said image support member and which electric field is opposite in direction to the field formed between the toner adhering region and the developing electrode during image area development by the toner;

(b) developing said carrier adhering region by said magnetic brush for causing said carrier to adhere to said carrier adhering region during said developing;

(c) measuring the current flowing between said developing electrode and said image support member during said adhesion of said carrier to said carrier adhering region; and (d) controlling the amount of toner supplied for replenishment of said magnetic developing material according to the value of the current thus measured.

2. A method as claimed in claim 1 wherein the carrier in said developing material is an electrically insulative resin having fine magnetic particles dispersed therein, the particles having an average particle diameter in the range of 5 to 40 $\mu$m.

3. A method as claimed in claim 1 wherein the forming of said electric field includes, during the developing of said carrier adhering region, the step of impressing a developing bias on said developing electrode in a direction for increasing the potential difference between said developing electrode and said carrier adhering region.

4. A method as claimed in claim 1 wherein the forming of said electric field includes, prior to the developing of said carrier adhering region, charging said carrier adhering region with a polarity opposite to that of the electrostatic latent image.

5. A method as claimed in claim 1 wherein the forming of said electric field includes, during the development of said carrier adhering region, applying a developing bias voltage having the polarity of said electrostatic latent image with respect to the surface potential of said carrier adhering region to said developing electrode.

6. A method of detecting concentration of an electrically insulative toner in a developing material for an electrophotographic copying apparatus equipped with a developing device including a developing electrode for developing an image region on the surface of an electrostatic latent image support member having an electrostatic latent image thereon with a polarity opposite to the charge polarity of the insulative toner, by the use of the developing material, the developing material being composed of a mixture of a carrier having a volume resistivity of more than $10^{10}$ $\Omega$·cm and the electrically insulative toner and which toner and carrier are respectively triboelectrically charged to different polarities, said method comprising the steps of:

(a) utilizing part of the surface of said image support member outside the image region thereof as a carrier adhering region by, at the time said carrier adhering region passes said developing electrode, forming an electric field between the surface of said image support member and said developing electrode in a direction and sufficiently strong for causing the carrier in the developing material to be electrostatically attracted onto the carrier adhering region of said image support member and which electric field is opposite in direction to the field formed between the toner adhering region and the developing electrode during image area development by the toner;

(b) developing said carrier adhering region by causing said carrier to adhere to said carrier adhering region during said developing; and (c) measuring the current flowing between said developing electrode and said image support member during the adhesion of the carrier, the current value thus measured being according to the concentration of the toner in said developing material.

* * * * *